US011163248B2

(12) United States Patent
Shimada

(10) Patent No.: US 11,163,248 B2
(45) Date of Patent: Nov. 2, 2021

(54) FIXING DEVICE AND IMAGE FORMING APPARATUS

(71) Applicant: Oki Data Corporation, Tokyo (JP)

(72) Inventor: Takenori Shimada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/095,458

(22) Filed: Nov. 11, 2020

(65) Prior Publication Data

US 2021/0165348 A1 Jun. 3, 2021

(30) Foreign Application Priority Data

Nov. 28, 2019 (JP) ..... JP2019-215410

(51) Int. Cl.
*G03G 15/20* (2006.01)

(52) U.S. Cl.
CPC ..... *G03G 15/2017* (2013.01); *G03G 15/2053* (2013.01); *G03G 15/2064* (2013.01)

(58) Field of Classification Search
CPC ..... G03G 15/2017; G03G 15/2053; G03G 15/2064
See application file for complete search history.

(56) References Cited

U.S. PATENT DOCUMENTS 5,499,087 A * 3/1996 Hiraoka ..... G03G 15/2064 219/216

FOREIGN PATENT DOCUMENTS

JP 2019128507 A 8/2019

* cited by examiner

*Primary Examiner* — Clayton E. LaBalle
*Assistant Examiner* — Michael A Harrison
(74) *Attorney, Agent, or Firm* — Rabin & Berdo, P.C.

(57) ABSTRACT

A fixing device includes a belt member, a heater, a base layer, and an opposed layer. The heater is provided on an inner circumferential surface of the belt member. The base layer includes a first surface on a heater side and a second surface on an opposite side to the first surface. The opposed layer covers the second surface and is opposed to the inner circumferential surface of the belt member. The base layer and the opposed layer satisfy the following conditional expression (1), $$0<(Tb\times Da)/(Ta\times Db)\leq 1.17 \quad (1)$$

where Ta is a thickness of the base layer in millimeters, Tb is a thickness of the opposed layer in millimeters, Da is a thermal diffusivity of the base layer in square millimeters per second, and Db is a thermal diffusivity of the opposed layer in square millimeters per second.

11 Claims, 8 Drawing Sheets

FIXING DEVICE AND IMAGE FORMING APPARATUS

CROSS REFERENCE TO RELATED APPLICATIONS

The present application claims priority from Japanese Patent Application No. 2019-215410 filed on Nov. 28, 2019, the entire contents of which are hereby incorporated by reference.

BACKGROUND

The technology relates to a fixing device and an image forming apparatus including the fixing device.

Some image forming apparatuses use a thermal fixing device to fix an image formed on a medium. For example, Japanese Unexamined Patent Application Publication No. 2019-128507 discloses a technique of diffusing heat generated by a heater to a fixing belt by means of a thermal diffusion member in the fixing device.

SUMMARY

A fixing device is expected to efficiently transmit heat generated by a heater to a fixing belt, and to favorably fix an image formed on a medium.

It is desirable to provide a fixing device and an image forming apparatus that obtain a favorable fixing performance.

According to one embodiment of the technology, there is provided a fixing device that includes a belt member, a heater, a base layer, and an opposed layer. The heater is provided on an inner circumferential surface of the belt member. The base layer includes a first surface on a heater side and a second surface on an opposite side to the first surface. The opposed layer covers the second surface and is opposed to the inner circumferential surface of the belt member. The base layer and the opposed layer satisfy the following conditional expression (1), $$0<(Tb\times Da)/(Ta\times Db)\leq 1.17 \quad (1)$$

where: Ta is a thickness of the base layer in millimeters; Tb is a thickness of the opposed layer in millimeters; Da is a thermal diffusivity of the base layer in square millimeters per second; and Db is a thermal diffusivity of the opposed layer in square millimeters per second.

According to one embodiment of the technology, there is provided an image forming apparatus that includes a fixing device. The fixing device includes a belt member, a heater, a base layer, and an opposed layer. The heater is provided on an inner circumferential surface of the belt member. The base layer includes a first surface on a heater side and a second surface on an opposite side to the first surface. The opposed layer covers the second surface and is opposed to the inner circumferential surface of the belt member. The base layer and the opposed layer satisfy the following conditional expression (1), $$0<(Tb\times Da)/(Ta\times Db)\leq 1.17 \quad (1)$$

where: Ta is a thickness of the base layer in millimeters; Tb is a thickness of the opposed layer in millimeters; Da is a thermal diffusivity of the base layer in square millimeters per second; and Db is a thermal diffusivity of the opposed layer in square millimeters per second.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the disclosure.

DETAILED DESCRIPTION

Figure 1:
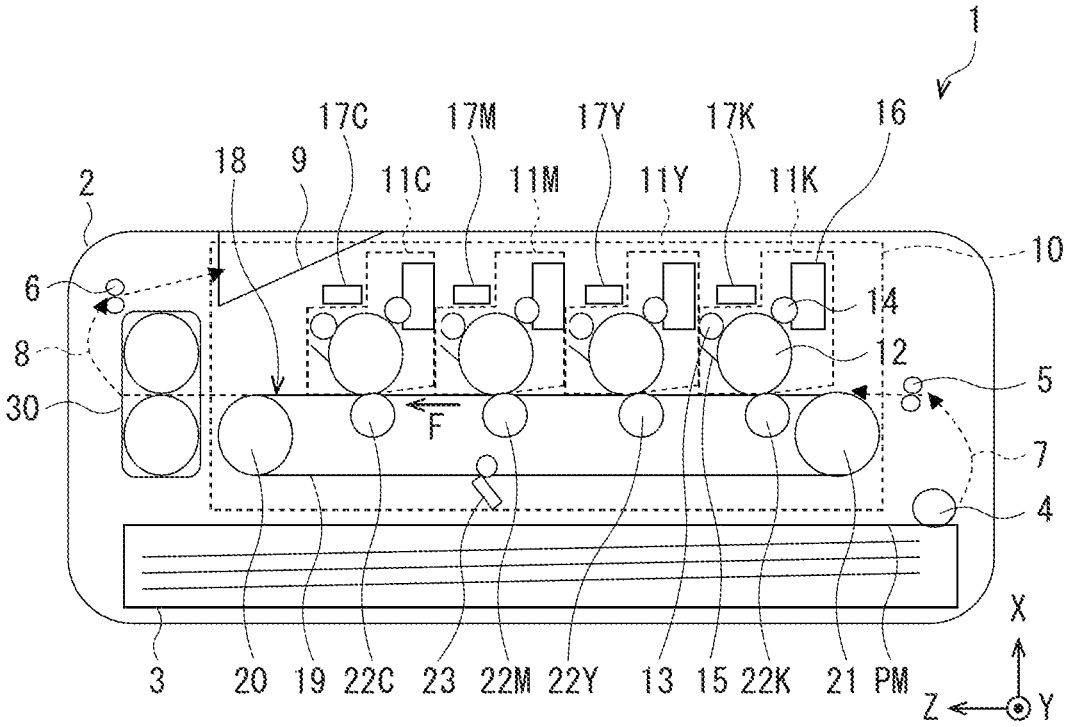
FIG. 1 is a schematic diagram illustrating an example of an overall configuration of an image forming apparatus according to an example embodiment of the technology.

Hereinafter, some example embodiments of the technology will be described in detail with reference to the drawings. Note that the following description is directed to illustrative examples of the technology and not to be construed as limiting to the technology. Factors including, without limitation, arrangement, dimensions, dimensional ratios, numerical values, shapes, materials, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be given in detail. The description will be given in the following order.

1. Example Embodiment
2. Experiment Examples
3. Modifications

1. Example Embodiment

[1.1 Outline of Configuration of Image Forming Apparatus 1]

FIG. 1 schematically illustrates an example of an overall configuration of an image forming apparatus 1 that includes a fixing device according to an example embodiment of the technology. The image forming apparatus 1 may be an electrophotographic printer, for example. The image forming apparatus 1 may perform image forming operation with use of a developer such as a toner, and may thereby form an image such as a monochrome image or a color image on a medium PM such as paper. Herein, a term "upstream" refers to a position that is closer to a medium feeding tray 3 as viewed from any position of interest on a conveying path along which the medium PM is conveyed, or a direction toward the medium feeding tray 3. A term "downstream" refers to a position that is closer to a stacker 9 as viewed from any position of interest on the conveying path, or a direction toward the stacker 9. The stacker 9 may be a member on which the discharged medium PM is placed. A direction from the upstream toward the downstream is referred to as a conveying direction F.

The image forming apparatus 1 may include, for example but not limited to, the medium feeding tray 3, a hopping roller 4, paired registration rollers 5, an image forming section 10, a fixing device 30, and paired discharging rollers 6. The medium feeding tray 3, the hopping roller 4, the paired registration rollers 5, the image forming section 10, the fixing device 30, and the paired discharging rollers 6 may be provided, for example, inside a body frame 2 that is a housing of a body of the image forming apparatus 1.

The medium feeding tray 3 may be a container that contains the medium PM. Placed on the medium feeding tray 3 may be a plurality of media PM. Provided downstream of the medium feeding tray 3 may be the hopping roller 4.

The hopping roller 4 may be a rotatable member that is in contact with a surface of the medium PM, and may feed the medium PM toward the downstream along a guide 7 which provides the conveying path. The hopping roller 4 may rotate about a central axis of the hopping roller 4 with use of power transmitted from an unillustrated hopping motor. Provided downstream of the hopping roller 4 may be the paired registration rollers 5.

The paired registration rollers 5 may convey the medium PM toward the image forming section 10. Upon conveying the medium PM, the paired registration rollers 5 may allow a leading end of the medium PM to abut against the paired registration rollers 5, and may thereby correct a skew of the medium PM. Provided downstream of the paired registration rollers 5 may be the image forming section 10.

[Image Forming Section 10]

The image forming section 10 may form an image (e.g., a toner image), and may transfer the formed image onto the medium PM. The image forming section 10 may include, for example but not limited to, four developing units 11 (i.e., developing units 11K, 11Y, 11M, and 11C), four exposure units 17 (i.e., exposure units 17K, 17Y, 17M, and 17C), and a transfer belt section 18.

The four developing units 11 (i.e., the developing units 11K, 11Y, 11M, and 11C) may each form an image with use of a toner, which is a developer, on the basis of print data transmitted from a host device such as a personal computer. The four developing units 11 may be attachable to and detachable from the image forming apparatus 1. For example, the developing unit 11K may form a black image, the developing unit 11Y may form a yellow image, the developing unit 11M may form a magenta image, and the developing unit 11C may form a cyan image. In this example, the developing units 11K, 11Y, 11M, and 11C may be disposed in this order in the conveying direction F in which the medium PM is to be conveyed. The developing units 11K, 11Y, 11M, and 11C may have substantially the same configuration except that the developing units 11K, 11Y, 11M, and 11C may form respective images with use of toners having colors different from each other, as described above. As illustrated in FIG. 1, the developing units 11 may each include, for example but not limited to, a photosensitive drum 12, a charging roller 13, a developing roller 14, a cleaning blade 15, and a toner container 16.

The photosensitive drum 12 may be a columnar member that carries an electrostatic latent image on a surface (i.e., a surficial part). The photosensitive drum 12 may include a photoreceptor (e.g., an organic photoreceptor). The photosensitive drum 12 may rotate clockwise in this example with use of power transmitted from an unillustrated photoreceptor motor. The photosensitive drum 12 may be electrically charged by the charging roller 13, and may be subjected to exposure by a corresponding one of the exposure units 17, thereby causing an electrostatic latent image to be formed on the surface of the photosensitive drum 12. Further, the photosensitive drum 12 may receive the toner from the developing roller 14, thereby causing an image corresponding to the electrostatic latent image to be formed (i.e., developed) on the photosensitive drum 12.

The charging roller 13 may electrically charge the surface (i.e., the surficial part) of the photosensitive drum 12. The charging roller 13 may be so disposed as to be in contact with a surface (i.e., a circumferential surface) of the photosensitive drum 12, and also as to be pressed against the photosensitive drum 12 at a predetermined pressing amount. The charging roller 13 may rotate counterclockwise in this example in accordance with the rotation of the photosensitive drum 12. The charging roller 13 may receive a predetermined charging voltage.

The developing roller 14 may carry the electrically-charged toner on a surface of the developing roller 14. The developing roller 14 may be so disposed as to be in contact with the surface (i.e., the circumferential surface) of the photosensitive drum 12, and also as to be pressed against the photosensitive drum 12 at a predetermined pressing amount. The developing roller 14 may rotate counterclockwise in this example with use of power transmitted from the unillustrated photoreceptor motor. The developing roller 14 may receive a predetermined developing voltage.

The cleaning blade 15 may scrape off a toner remaining on the surface of the photosensitive drum 12, and may thereby clean the surface of the photosensitive drum 12. The cleaning blade 15 may be so disposed as to be in contact with the surface of the photosensitive drum 12 from a counter direction, and also as to be pressed against the photosensitive drum 12 at a predetermined pressing amount.

The toner container 16 may contain a toner. For example, the toner container 16 of the developing unit 11K may contain a black toner, the toner container 16 of the developing unit 11Y may contain a yellow toner, the toner container 16 of the developing unit 11M may contain a magenta toner, and the toner container 16 of the developing unit 11C may contain a cyan toner.

The four exposure units 17 (i.e., the exposure units 17K, 17Y, 17M, and 17C) may each apply light to the photosensitive drum 12 of corresponding one of the four developing units 11, and may each include, for example, a light-emitting diode (LED) head. For example, the exposure unit 17K may apply light to the photosensitive drum 12 of the developing unit 11K, the exposure unit 17Y may apply light to the photosensitive drum 12 of the developing unit 11Y, the exposure unit 17M may apply light to the photosensitive drum 12 of the developing unit 11M, and the exposure unit 17C may apply light to the photosensitive drum 12 of the developing unit 11C. This may cause an electrostatic latent image to be formed on the surface of each of the photosensitive drums 12. This allows an image corresponding to the electrostatic latent image to be formed on each of the photosensitive drums 12.

The transfer belt section 18 may transfer the image formed on the surface of the photosensitive drum 12 onto a surface of the medium PM with use of Coulomb force, and may convey the medium PM in the conveying direction F. The transfer belt section 18 may convey the medium PM with the transferred image toward the fixing device 30. The transfer belt section 18 may include, for example but not limited to, a transfer belt 19, a driving roller 20, a driven roller 21, and four transfer rollers 22 (i.e., transfer rollers 22K, 22Y, 22M, and 22C), and a cleaning blade 23. The transfer belt 19 may be a seamless annular belt capable of carrying the medium PM. The transfer belt 19 may lie on the driving roller 20 and the driven roller 21 while being stretched. The driving roller 20 may be a rotatable member that so rotates as to convey the medium PM toward the fixing device 30 with use of power transmitted from an unillustrated belt motor. The driving roller 20 may cause the transfer belt 19 to circularly rotate. The driven roller 21 may adjust tension applied to the transfer belt 19 while stretching the transfer belt 19 in association with the driving roller 20. The four transfer rollers 22 may each be a rotatable member that transfers an image formed on the surface of the photosensitive drum 12 of the corresponding one of the developing units 11 onto a transfer surface of the medium PM. The transfer roller 22K may be opposed to the photosensitive drum 12 of the developing unit 11K with the transfer belt 19 therebetween, the transfer roller 22Y may be opposed to the photosensitive drum 12 of the developing unit 11Y with the transfer belt 19 therebetween, the transfer roller 22M may be opposed to the photosensitive drum 12 of the developing unit 11M with the transfer belt 19 therebetween, and the transfer roller 22C may be opposed to the photosensitive drum 12 of the developing unit 11C with the transfer belt 19 therebetween. The transfer rollers 22K, 22Y, 22M, and 22C may each receive a predetermined transfer voltage. This may cause the image formed on the photosensitive drum 12 by the developing unit 11 to be transferred onto the transfer surface of the medium PM in the image forming apparatus 1. The cleaning blade 23 may scrape off the waste toner remaining on the surface of the transfer belt 19, and may thereby clean the surface of the transfer belt 19. Provided downstream of the image forming section 10 may be the fixing device 30.

[Fixing Device 30]

The fixing device 30 may apply heat and pressure to the image transferred on the medium PM conveyed from the transfer belt section 18, and may thereby fix the image to the medium PM. In the image forming apparatus 1, the fixing device 30 may fix the image to the medium PM, and may convey the medium PM along the guide 8, which provides the conveying path, toward the paired discharging rollers 6. Provided downstream of the fixing device 30 may be the paired discharging rollers 6.

The paired discharging rollers 6 may convey the medium PM toward the stacker 9. With this configuration, the image forming apparatus 1 may discharge the medium PM to the stacker 9. The stacker 9 may be provided outside the body frame 2. The stacker 9 may be a part on which the medium PM with the fixed image is to be placed.

[Detailed Configuration of Fixing Device 30]

Figure 2:
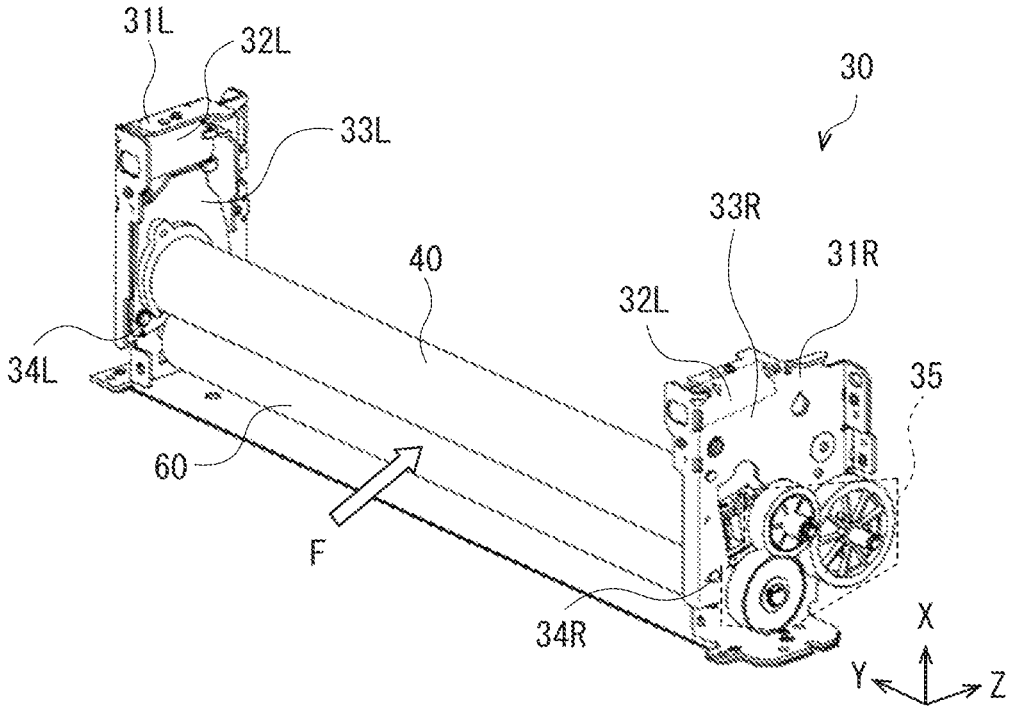
FIG. 2 is a perspective view of an example of a configuration of a part of a fixing device illustrated in FIG. 1.
Figure 3:
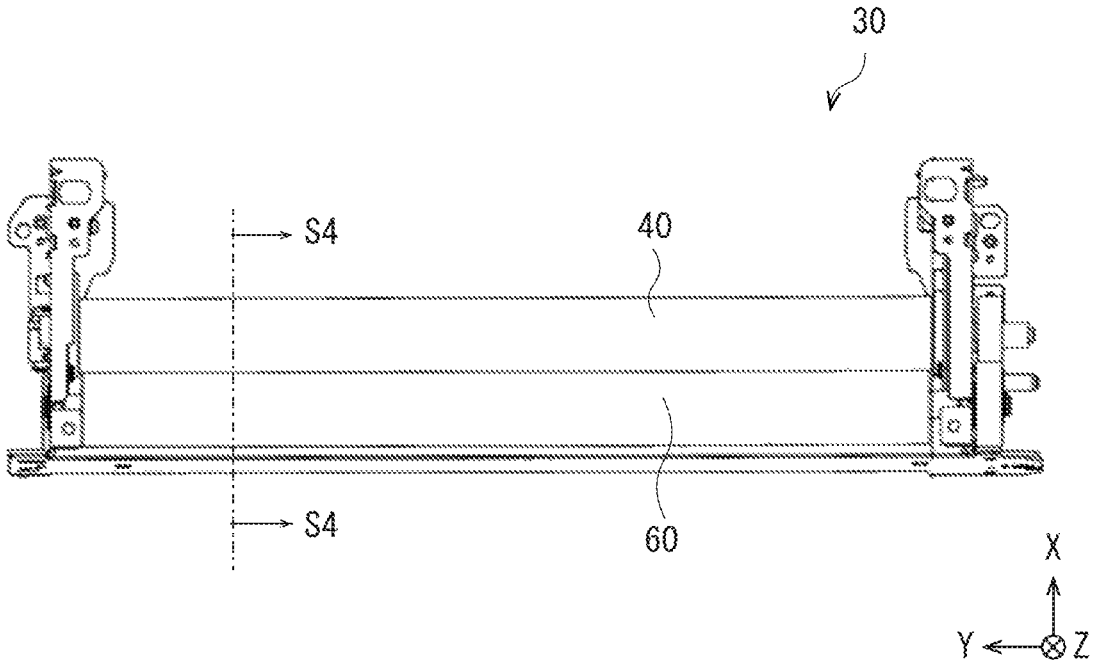
FIG. 3 is a front view of an example of a configuration of a part of the fixing device illustrated in FIG. 1.
Figure 4:
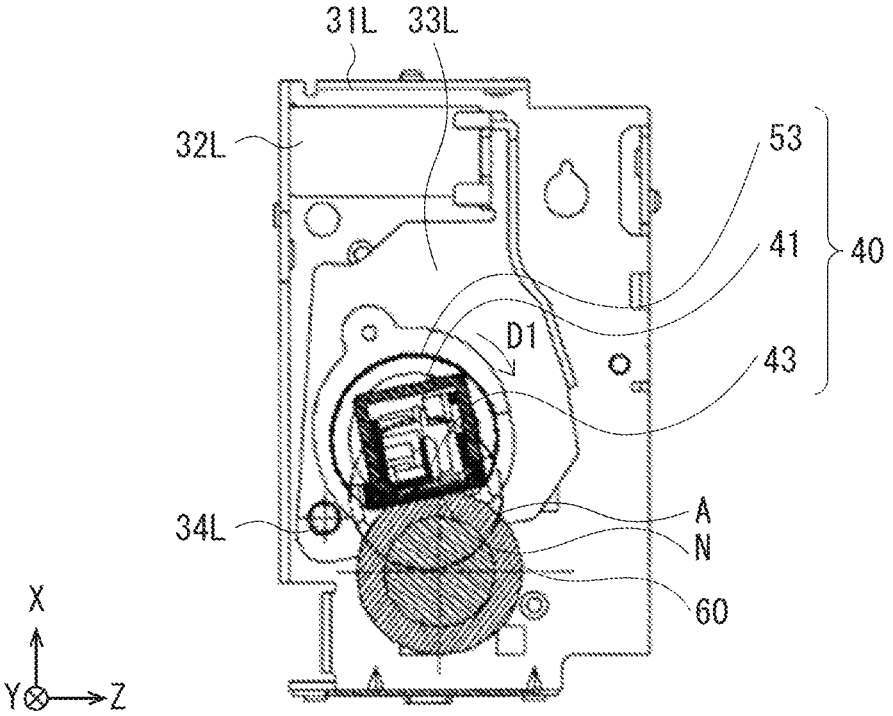
FIG. 4 is a cross-sectional view of an example of the configuration of the part of the fixing device illustrated in FIG. 3.
Figure 5:
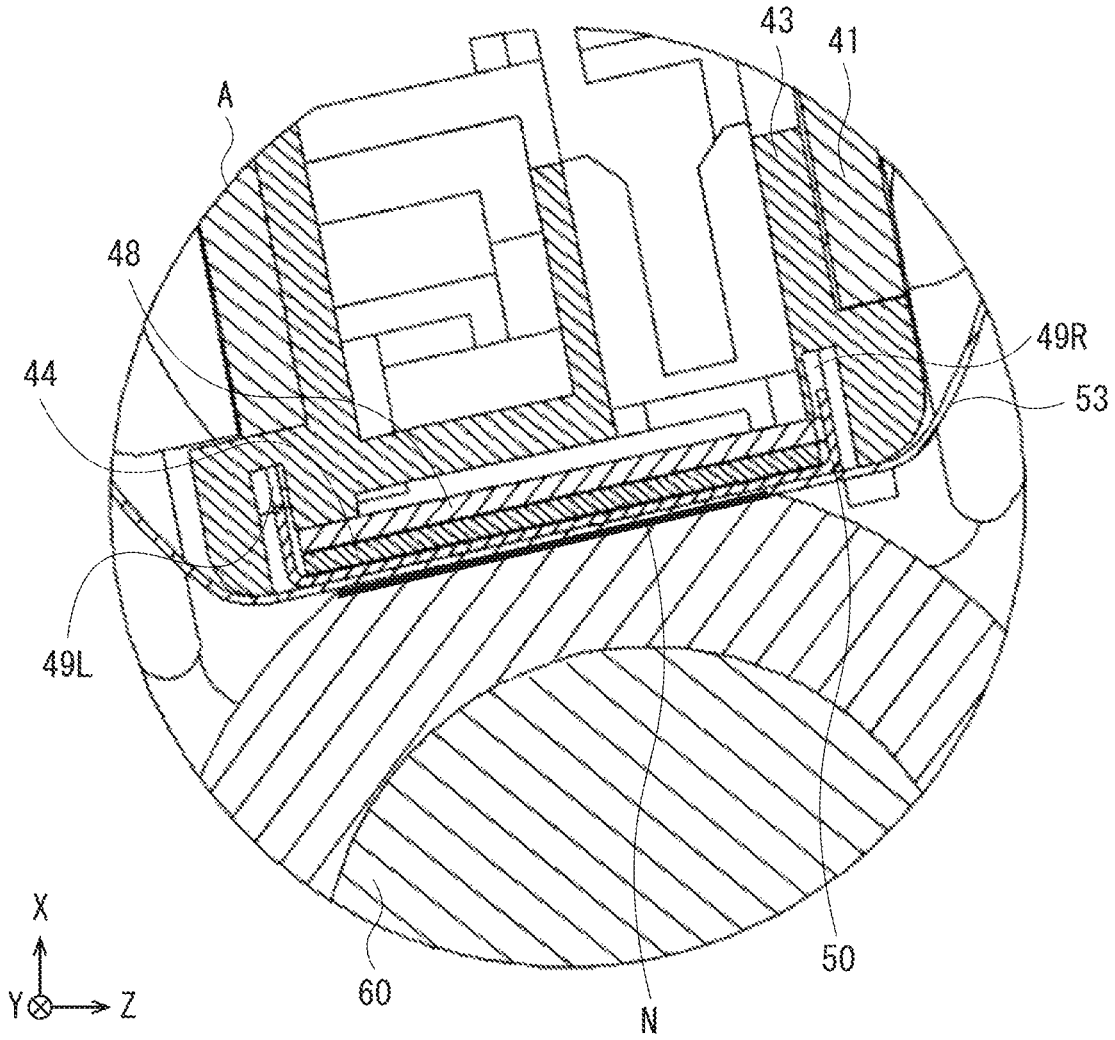
FIG. 5 is an enlarged cross-sectional view of a part of the example of the configuration of the part of the fixing device illustrated in FIG. 4.
Figure 6:
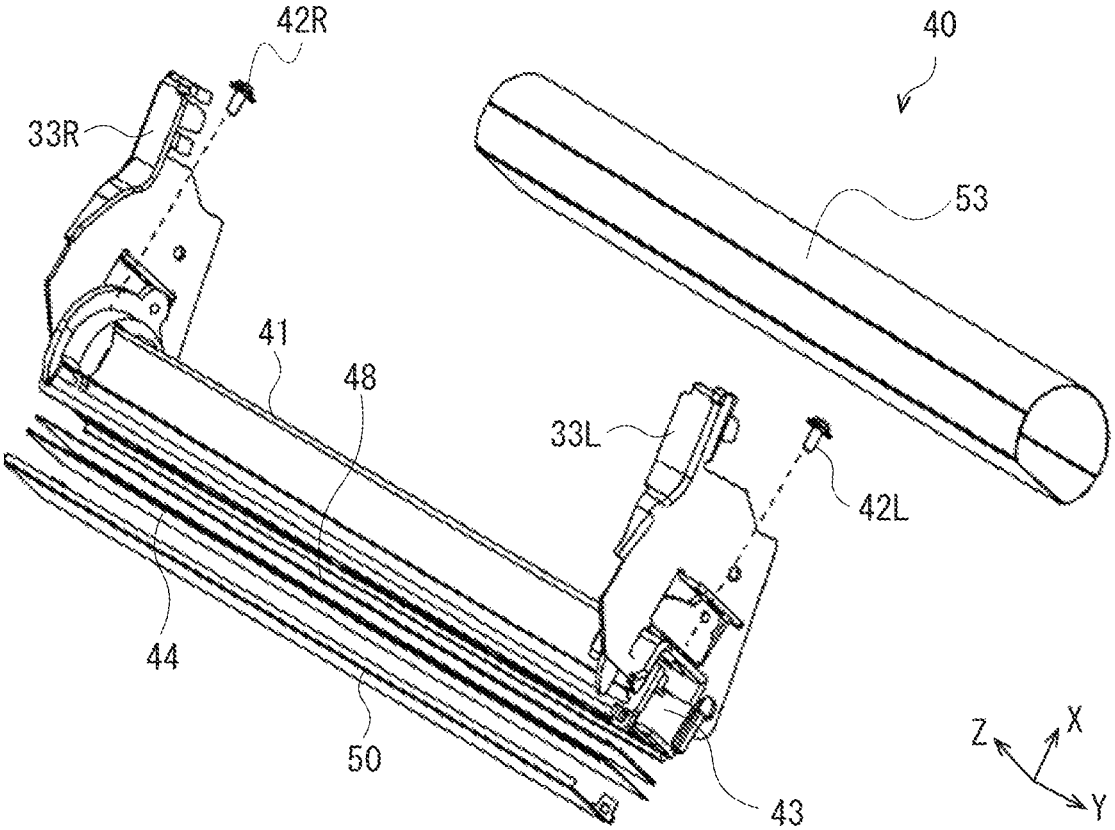
FIG. 6 is an exploded perspective view of an example of a fixing belt section illustrated in FIG. 2.

Referring to FIGS. 2 to 6, a detailed configuration of the fixing device 30 is described below. FIG. 2 is a perspective view of some components of the fixing device 30. FIG. 3 is a front view of some components of the fixing device 30, viewed from a Z-axis direction. FIG. 4 is a cross-sectional view of some components of the fixing device 30, taken along a line S4-S4 illustrated in FIG. 3. FIG. 5 is an enlarged cross-sectional view of a region A illustrated in FIG. 4. FIG. 6 is an exploded perspective view of a fixing belt section 40 which will be described later. FIG. 6 further illustrates levers 33L and 33R, which will be described later, in addition to the fixing belt section 40.

As illustrated in FIG. 2, the fixing device 30 may include, for example but not limited to, side frames 31L and 31R, springs 32L and 32R, the levers 33L and 33R, a drive gear 35, the fixing belt section 40, and a pressure-applying roller 60.

The side frames 31L and 31R may be fixed, for example, to the body frame 2 of the image forming apparatus 1 with use of a component such as a screw. As illustrated in FIGS. 2 and 4, the spring 32L may be, for example, an elastic member such as a spring, and may apply biasing force to the lever 33L. The spring 32L may have one end fixed to the side frame 31L, and may have the other end fixed to the lever 33L. As with the spring 32L, the spring 32R may be an elastic member such as a spring, and may apply biasing force to the lever 33R. The lever 33L may rotate about a rotation fulcrum 34L as a rotational axis in a D1 direction on an XZ plane, with use of the biasing force applied from the spring 32L. The lever 33L may be attached to the side frame 31L. As with the lever 33L, the lever 33R may rotate about a rotation fulcrum 34R as a rotational axis in the D1 direction on the XZ plane with use of the biasing force applied from the spring 32R. In a case where the fixing device 30 does not perform fixing operation, the levers 33L and 33R may each be pressed against a predetermined position by an unillustrated lever fixing member. That is, because the spring 32L may be pressed by the lever fixing member via the lever 33L, releasing of the lever 33L from the lever fixing member may allow the spring 32L to apply the biasing force to the lever 33L. This may be similarly applicable to the spring 32R. The drive gear 35 may transmit power from an unillustrated fixing belt motor to the pressure-applying roller 60.

With this configuration, in a case where the fixing device 30 performs the fixing operation, the drive gear 35 may transmit power from the fixing belt motor to the pressure-applying roller 60. Further, the levers 33L and 33R may be released from the lever fixing member in response to the operation of the drive gear 35. This may cause the levers 33L and 33R to rotate in the D1 direction about the rotation fulcrums 34L and 34R as the rotational axes, respectively. This may cause the fixing belt section 40 attached to the levers 33L and 33R to be pressed against the pressure-applying roller 60, thereby providing a nip part N at the fixing belt section 40 and the pressure-applying roller 60. FIG. 4 illustrates a state in which the nip part N is provided at the fixing belt section 40 and the pressure-applying roller 60. When the medium PM passes through the nip part N, heat and pressure may be thereby applied to the image transferred on the medium PM, which by the image may be fixed to the medium PM.

[Fixing Belt Section 40]

The fixing belt section 40 may apply heat to the image on the medium PM. As illustrated in FIGS. 4 to 6, the fixing belt section 40 may include, for example but not limited to, a stay 41, a holding member 43, a heater 44, a heat-retaining member 48, a thermal diffusion member 50, and a fixing belt 53. The stay 41 may support the fixing belt 53. The stay 41 may be fixed to the lever 33L with the screw 42L, and may be fixed to the lever 33R with a screw 42R. The holding member 43 may hold the heater 44, the heat-retaining member 48, and the thermal diffusion member 50. The holding member 43 may be fixed to the stay 41. As illustrated in FIGS. 5 and 6, the heat-retaining member 48, the heater 44, the thermal diffusion member 50, and the fixing belt 53 may be disposed in this order substantially in an X-axis direction. That is, the heat-retaining member 48 may be opposed to the heater 44, the heater 44 may be opposed to the thermal diffusion member 50, and the thermal diffusion member 50 may be opposed to the fixing belt 53. The heater 44 is provided on an inner circumferential surface of the fixing belt 53. Note that the fixing belt 53 may be an annular belt. The fixing belt 53 may correspond to a "belt member" in one specific but non-limiting embodiment of the technology.

Figure 7:
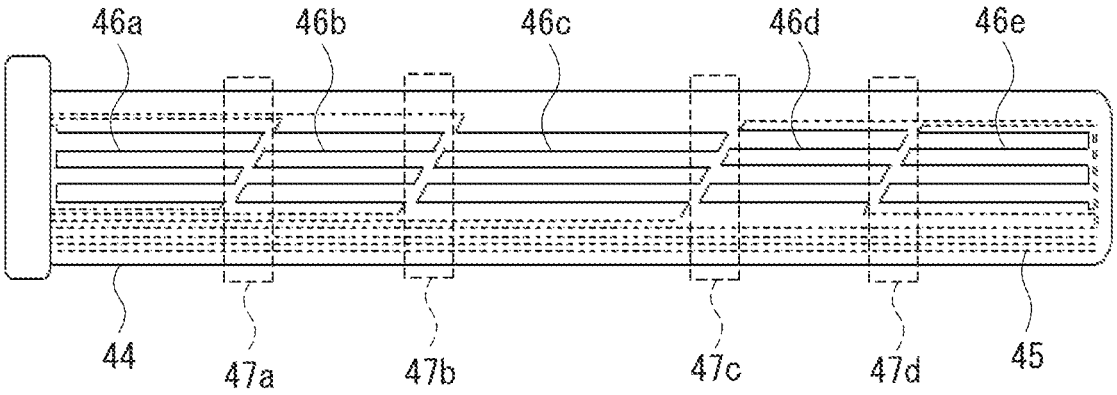
FIG. 7 is a diagram for describing an example of an outline of a heater illustrated in FIG. 5.

FIG. 7 describes an outline of the heater 44. The heater 44 may be a plate-shaped member extending in a Y-axis direction. The heater 44 may be a heat source that heats the fixing belt 53. The heater 44 may include, for example but not limited to, an electric wire 45, heat generating parts 46*a* to 46*e*, and joining parts 47*a* to 47*d*. The electric wire 45 may cause a current supplied from an external power source to flow to each of the heat generating parts 46*a* to 46*d*. The electric wire 45 may include, for example, copper (Cu).

The heat generating parts 46*a* to 46*e* may each include a resistive heat generating body. The resistive heat generating body may include, for example, nickel-chromium alloy (NiCr) or silver-palladium alloy (AgPd). For example, in a case where an image is to be formed on the medium PM having a great width such as A3 paper, the heater 44 may cause the heat generating parts 46*a* to 46*e* to generate heat. For example, in a case where an image is to be formed on the medium PM having a small width such as a postcard, the heater 44 may cause the heat generating part 46*c* to generate heat. With this configuration, the heater 44 allows for reduction in energy consumption. A direction orthogonal to a plane defined by a longer-side direction (i.e., the Y-axis direction) of the heater 44 and a shorter-side direction (substantially, the Z-axis direction) of the heater 44 is hereinafter referred to as a thickness direction (substantially, the X-axis direction). The shorter-side direction of the heater 44 may be orthogonal to the longer-side direction of the heater 44.

In the heater 44, the joining part 47*a* may be a boundary region between a pattern of the heat generating part 46*a* and a pattern of the heat generating part 46*b*. The joining part 47*b* may be a boundary region between the pattern of the heat generating part 46*b* and a pattern of the heat generating part 46*c*. The joining part 47*c* may be a boundary region between the pattern of the heat generating part 46*c* and a pattern of the heat generating part 46*d*. The joining part 47*d* may be a boundary region between the pattern of the heat generating part 46*d* and a pattern of the heat generating part 46*e*. That is, in a case where the heater 44 generates heat, a temperature distribution in the longer-side direction (i.e., the Y-axis direction) of the heater 44 may be non-uniform between the joining parts 47*a* to 47*d*. Note that, although the heater 44 may include the heat generating parts 46*a* to 46*e* in this example, this is non-limiting. It may suffice that the heater 44 includes one or more heat generating parts. Further, although the heater 44 may include the joining parts 47*a* to 47*d* in this example, this is non-limiting. Alternatively, for example, the heater 44 may include a single heat generating part and no joining part.

The heat-retaining member 48 may store heat generated by the heater 44. In this example, the heat-retaining member 48 may be a plate-shaped member extending in the Y-axis direction along the heater 44. The heat-retaining member 48 may make it difficult for the heat generated by the heater 44 to be transmitted to a surface side opposite to a surface, of the heat-retaining member 48, opposed to the heater 44.

Between the heater 44 and the heat-retaining member 48, a heat-conductive grease may be applied to efficiently transmit the heat generated by the heater 44. Similarly, a heat-conductive grease may be also applied between the heater 44 and the thermal diffusion member 50. The heater 44 and the heat-retaining member 48 may be sandwiched between the holding member 43 and the thermal diffusion member 50, and may be fixed by the holding member 43. Note that, although the heat-conductive grease may be applied between the heater 44 and the heat-retaining member 48 in this example, this is non-limiting. In one example, the heat-conductive grease may not be applied. Further, although the heat-conductive grease may be applied between the heater 44 and the thermal diffusion member 50, this is non-limiting. In one example, the heat-conductive grease may not be applied.

The thermal diffusion member 50 may have a substantially-flat plate shape extending in the Y-axis direction along the heater 44. The thermal diffusion member 50 may transmit the heat generated by the heater 44 to the fixing belt 53. The thermal diffusion member 50 may have a shape with both ends of the thermal diffusion member 50 being bent in the thickness direction when viewed from the XZ plane. That is, the thermal diffusion member 50 may have a depression opposed to the heater 44 when viewed from the XZ plane. As illustrated in FIG. 5, protrusions of the thermal diffusion member 50, viewed from the XZ plane, may be inserted into the holding grooves 49L and 49R provided in the holding member 43. The holding grooves 49L and 49R may each be a space greater than each of the protrusions of the thermal diffusion member 50. This allows the thermal diffusion member 50 inserted in the holding grooves 49L and 49R to be movable in the thickness direction (substantially, the X-axis direction) by the fixing belt section 40 being pressed against the pressure-applying roller 60. That is, in a case where the fixing device 30 is to perform the fixing operation, the thermal diffusion member 50 may be pressed against the heater 44. In this case, the thermal diffusion member 50 may transmit the heat generated by the heater 44 to the fixing belt 53. In this example, a length in the longer-side direction (i.e., the Y-axis direction) of the thermal diffusion member 50 may be 264.9 mm, and a length in the shorter-side direction (substantially, the Z-axis direction) orthogonal to the longer-side direction of the thermal diffusion member 50 may be 17.55 mm. Further, a length in the thickness direction of each of the protrusions of the thermal diffusion member 50 to be inserted into the holding grooves 49R may be 7.5 mm.

Figure 8:
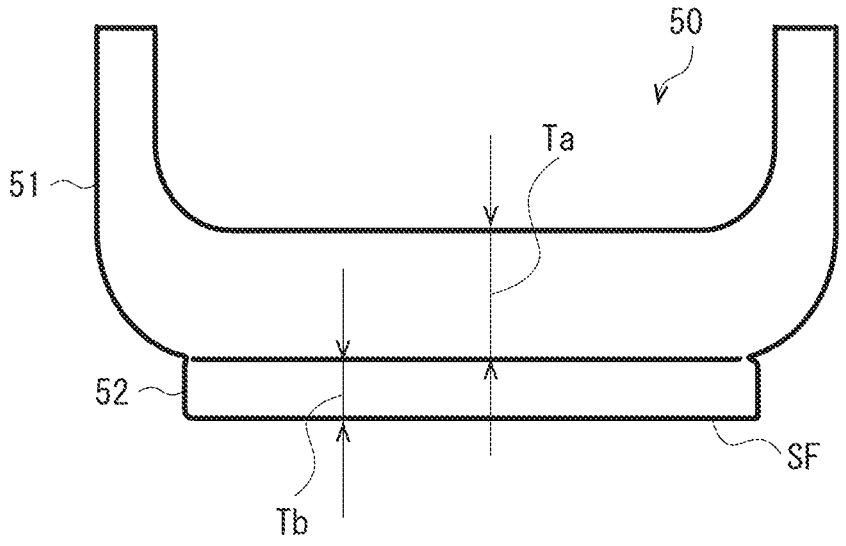
FIG. 8 is a schematic cross-sectional view for describing an example of an outline of a thermal diffusion member illustrated in FIG. 5.

FIG. 8 is a schematic cross-sectional view for describing an outline of the thermal diffusion member 50. The thermal diffusion member 50 includes a base layer 51 and an opposed layer 52. The base layer 51 includes a first surface on the heater 44 side and a second surface on the opposite side to the first surface. That is, the opposed layer 52 covering the second surface of the base layer 51 may be provided on the base layer 51.

The base layer 51 may include, for example, metal having a great thermal diffusivity. The thermal diffusivity may indicate a speed of heat transmission. A thickness Ta of the base layer 51 may be, for example, 0.485 mm. A thermal diffusivity Da of the base layer 51 may be, for example, 57.7 $mm^2/s$. In this example, the base layer 51 may include aluminum (Al) as a major component. Here, the major component refers to a component occupying 50 wt % of the entire base layer 51. That is, a content of Al in the base layer 51 may be greater than those of other materials. Note that, although the base layer 51 may include Al in this example, this is non-limiting. In one example, the base layer 51 may include any other metal having a great thermal diffusivity. For example, the base layer 51 may include metal such as stainless-steel (SUS), copper, or zinc (Zn). Note that the thickness Ta of the base layer 51 is not limited to the exemplified thickness.

The opposed layer 52 may include, for example, resin having a favorable slidability with respect to an inner circumferential surface of the fixing belt 53. In one example embodiment, a thickness Tb of the opposed layer 52 may be equal to or greater than 0.005 mm and equal to or less than 0.015 mm. For example, the thickness Tb of the opposed layer 52 may be 0.015 mm. A thermal diffusivity Db of the opposed layer 52 may be, for example, 1.53 $mm^2/s$. That is, the thermal diffusivity Db of the opposed layer 52 may be smaller than the thermal diffusivity Da of the base layer 51, and the thickness Tb of the opposed layer 52 may be smaller than the thickness Ta of the base layer 51. In this example, the opposed layer 52 may include polyamideimide (PAI) having a high toughness as a major component, and may further include polytetrafluoroethylene (PTFE). Here, the major component refers to a component occupying 50 wt % of the entire opposed layer 52. That is, a content of PAI in the opposed layer 52 may be greater than those of other materials. Further, a filler such as graphite may be added to the opposed layer 52 to improve slidability and thermal conductivity of the opposed layer 52. In this example, for example, a solvent of PAI including PTFE may be sprayed onto one surface of the base layer 51 with use of a spray. The sprayed solvent may be heated, whereby the resin may be cured. This may form the opposed layer 52 on the base layer 51. The thickness Tb of the opposed layer 52 may be controlled, for example, by adjusting the number of times of spray application. In this example, a length in a longer-side direction (i.e., the Y-axis direction) of the opposed layer 52 may be about 264.9 mm, and a length in a shorter-side direction (substantially, the Z-axis direction) of the opposed layer 52 may be about 17.55 mm. That is, the opposed layer 52 may cover substantially the entire surface, of the base layer 51, opposed to the inner circumferential surface of the fixing belt 53. The opposed layer 52 may include an opposed surface SF on an opposite side to the base layer 51. The opposed surface SF may be opposed to the fixing belt 53. Applied on the opposed surface SF may be a sliding grease to improve slidability. The opposed surface SF may slide against the fixing belt 53 with the sliding grease therebetween. The sliding grease may be, for example, a gel grease, and may include a material such as a silicone-based material or a fluorine-based material. Note that, although the opposed layer 52 may include PAI in this example, this is non-limiting. In one example, the opposed layer 52 may include any other resin having favorable slidability. Further, although the filler such as graphite may be added to PAI in this example, this is non-limiting. In one example, the filler may not be added. Further, although the opposed layer 52 may cover substantially the entire second surface, of the base layer 51, opposed to the inner circumferential surface of the fixing belt 53, this is non-limiting. Alternatively, in one example, the opposed layer 52 may cover a part of the second surface, of the base layer 51, opposed to the inner circumferential surface of the fixing belt 53. Further, although the sliding grease may be applied to the opposed surface SF in this example, this is non-limiting. In one example, the sliding grease may not be applied. Note that the thickness Tb of the opposed layer 52 is not limited to the exemplified thickness. The sliding grease may correspond to a "lubricant" in one specific but non-limiting embodiment of the technology.

In the thermal diffusion member 50, because the thermal diffusivity Db of the opposed layer 52 may be smaller than the thermal diffusivity Da of the base layer 51, the greater the thickness Tb of the opposed layer 52 is relative to the thickness Ta of the base layer 51, the longer the time of heat transmission in the thickness direction becomes. In such a case, in order to compensate for the heat transmitted to the medium PM in the fixing operation, it may be desired to increase the temperature of the fixing belt 53 from a predetermined temperature. That is, there is a possibility of an increase in a lower limit, of a surface temperature of the fixing belt 53, that allows fixability of an image to the medium PM to satisfy a predetermined condition. Such a lower limit of the surface temperature of the fixing belt 53 is hereinafter referred to as a fixing limit temperature. In contrast, the greater the thermal diffusivity Db of the opposed layer 52 is relative to the thermal diffusivity Da of the base layer 51, the greater the thermal diffusivity of the thermal diffusion member 50 as a whole in the thickness direction becomes, and the shorter the time of the heat transmission in the thickness direction becomes. In such a case, the heat transmitted to the medium PM can be compensated for in the fixing operation, even if the temperature of the fixing belt 53 is a predetermined temperature. That is, the fixing limit temperature may not increase. In other words, it may be desired that a ratio of the thickness Tb relative to the thickness Ta be small and a ratio of the thermal diffusivity Da relative to the thermal diffusivity Db be small. In one example embodiment, the base layer 51 and the opposed layer 52 satisfy a conditional expression (1).

$$0<(Tb\times Da)/(Ta\times Db)\leq 1.17 \quad (1)$$

Here, a product of the ratio of the thickness Tb relative to the thickness Ta and the ratio of the thermal diffusivity Da relative to the thermal diffusivity Db may be set as a heat transmission contribution rate. In this example, the heat transmission contribution rate may be 1.17.

The fixing belt 53 may be an annular belt that lies on the stay 41 while being stretched with predetermined tension by the stay 41. The fixing belt 53 may be rotatably held. The fixing belt 53 may include the inner circumferential surface opposed to the opposed surface SF. The fixing belt 53 may be so provided as to slide on the opposed surface SF by the inner circumferential surface. The fixing belt 53 may provide the nip part N between the fixing belt 53 and the pressure-applying roller 60.

Figure 9:
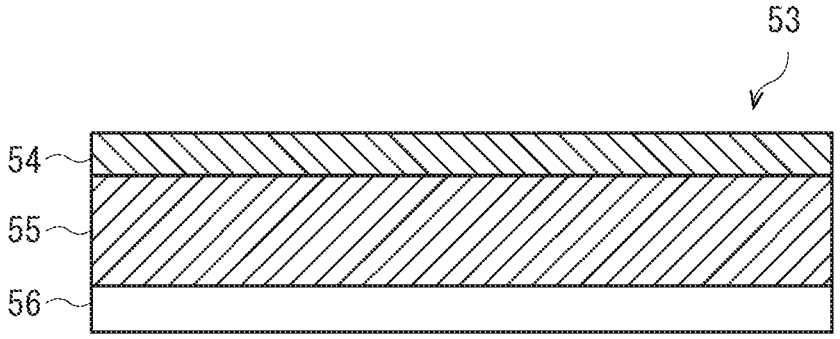
FIG. 9 is a schematic cross-sectional view for describing an example of an outline of a fixing belt illustrated in FIG. 4.

FIG. 9 is a schematic cross-sectional view for describing an outline of the fixing belt 53. The fixing belt 53 may include, for example but not limited to, a surface layer 54, an elastic layer 55, and a base layer 56. That is, the elastic layer 55 may be provided on the base layer 56, and the surface layer 54 may be provided on the elastic layer 55.

The surface layer 54 may include a copolymer (PFA) of tetrafluoroethylene and perfluoroalkyl vinyl ether in this example. A thickness of the surface layer 54 may be, for example, 20 μm. It may be desired that the thickness of the surface layer 54 be so set that the surface layer 54 is allowed to follow deformation of the elastic layer 55. On the other hand, if the thickness of the surface layer 54 is excessively small, the surface layer 54 can wrinkle due to sliding against the pressure-applying roller 60 or the medium PM. Accordingly, in one example embodiment, the thickness of the surface layer 54 may be equal to or greater than 10 μm and equal to or less than 50 μm. Further, it may be desired that the surface layer 54 have heat resistance that allows the surface layer 54 to be resistant to the fixing temperature. It may be also desired that the surface layer 54 have releasability that makes it difficult for the toner remaining on the fixing belt 53 or paper dust derived from the medium PM to be attached to the surface layer 54. Accordingly, in one example embodiment, the surface layer 54 may include a fluorine-substituted material. Note that the material included in the surface layer 54 is not limited to the exemplified material, and the thickness of the surface layer 54 is not limited to the exemplified thickness.

The elastic layer 55 may include silicone rubber having heat resistance that allows the elastic layer 55 to be resistant to the fixing temperature, in this example. Rubber hardness of the elastic layer 55 may be, for example, 12 degrees, and the thickness of the elastic layer 55 may be, for example, 200 μm. It may be desired that the elastic layer 55 have rubber hardness and a thickness that allow for provision of the nip part N. On the other hand, it may be desired that the elastic layer 55 reduce loss in quantity of the heat generated by the heater 44 and transmit the heat generated by the heater 44 efficiently to an outer circumferential surface (i.e., a toner contact surface) of the fixing belt 53. If the thickness of the elastic layer 55 is great, it is easier to provide the uniform nip part N but a heat capacity is increased, which in turn increases heat loss. Therefore, it may not be preferable to provide the elastic layer 55 with a great thickness. In one example embodiment, the thickness of the elastic layer 55 may be within a range from 50 μm to 500 μm both inclusive. Further, in one example embodiment, the rubber hardness of the elastic layer 55 may be within a range from 10 degrees to 60 degrees both inclusive in order to improve uniformity of the nip part N. Note that, although the elastic layer 55 may include silicone rubber in this example, this is non-limiting. In one example, the elastic layer 55 may include any other material having heat resistance that allows the elastic layer 55 to be resistant to the fixing temperature. For example, the elastic layer 55 may include fluororubber. Note that the thickness of the elastic layer 55 is not limited to the exemplified thickness.

In this example, the base layer 56 may include polyimide (PI) as a major component. Here, the major component refers to a component occupying 50 wt % of the entire base layer 56. That is, a content of PI in the base layer 56 may be greater than those of other materials. An inner diameter of the base layer 56 may be, for example, 30 mm. A thickness of the base layer 56 may be, for example, 80 μm. The base layer 56 may provide the fixing belt 53 with durability and mechanical strength. The base layer 56 may be superior in mechanical strength, repeated bending durability, and buckling durability. That is, the base layer 56 may have a great Young's modulus and great buckling strength, therefore making it difficult for the fixing belt 53 to be broken. Note that although the base layer 56 may include PI in this example, this is non-limiting. Alternatively, in one example, the base layer 56 may include any other material having great heat resistance, great Young's modulus, and great buckling strength. The base layer 56 may include, for example, stainless steel or a polyether ether ketone (PEEK) material. In one example embodiment, the base layer 56 may include a resin material having superior heat resistance such as polytetrafluoroethylene (PTFE). For example, the base layer 56 may include a material to which an electrically-conductive filler including a metal element such as carbon black or zinc is added. This may provide the base layer 56 with electrical conductivity. For example, the base layer 56 may include PTFE to which a filler such as boron nitride is added. This may improve a sliding characteristic or thermal conductivity of the base layer 56. Note that the thickness of the base layer 56 is not limited to the exemplified thickness.

[Pressure-Applying Roller 60]

Figure 10:
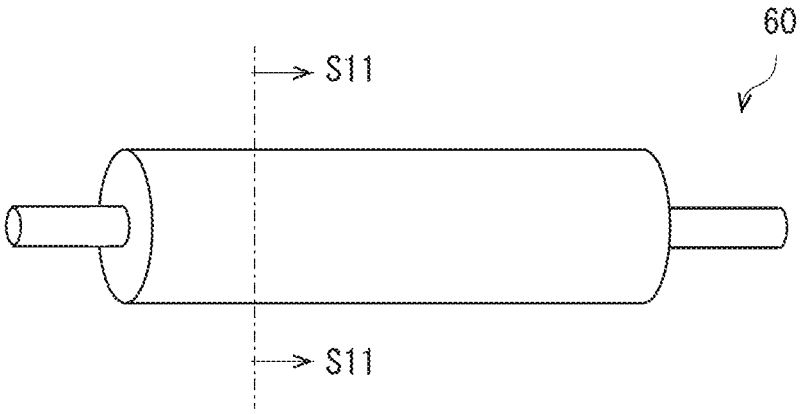
FIG. 10 is a diagram for describing an example of an outline of a pressure-applying roller illustrated in FIG. 2.
Figure 11:
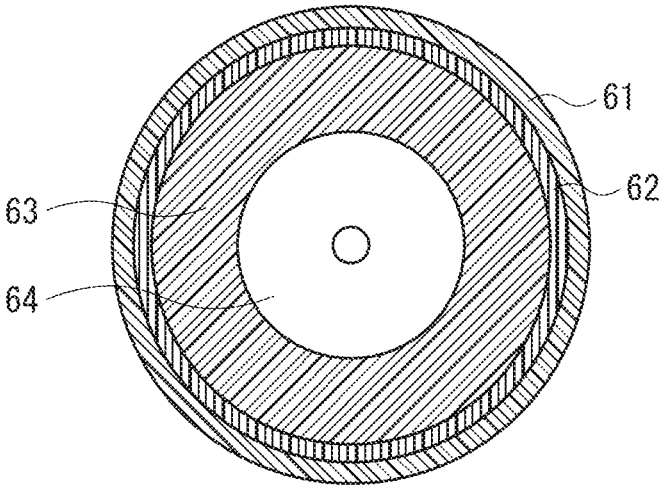
FIG. 11 is a schematic cross-sectional view for describing the example of the outline of the pressure-applying roller illustrated in FIG. 10.

FIG. 10 describes an outline of the pressure-applying roller 60. FIG. 11 is a schematic cross-sectional view of the pressure-applying roller 60 taken along a line S11-S11 illustrated in FIG. 10. The pressure-applying roller 60 may be a rotatable member that is so provided as to be able to come into contact with the outer circumferential surface of the fixing belt 53 of the fixing belt section 40 and to thereby provide the nip part N between the pressure-applying roller 60 and the fixing belt section 40. Further, the pressure-applying roller 60 may apply pressure to the image on the medium PM. In one example embodiment, an outer diameter of the pressure-applying roller 60 may be 40 mm, and hardness of the pressure-applying roller 60 may be within a range from 50 degrees to 65 degrees both inclusive. The pressure-applying roller 60 may include, for example but not limited to, a surface layer 61, an adhesive layer 62, an elastic layer 63, and a shaft 64. That is, the elastic layer 63 may be provided on the shaft 64, the adhesive layer 62 may be provided on the elastic layer 63, and the surface layer 61 may be provided on the adhesive layer 62. Note that another adhesive layer may be provided between the shaft 64 and the elastic layer 63.

The surface layer 61 may include PFA, in this example. A thickness of the surface layer 61 may be, for example, 30 μm. The surface layer 61 may slide against the medium PM and the fixing belt 53. In one example embodiment, as with the surface layer 54 of the fixing belt 53, the thickness of the surface layer 61 may be so set that the surface layer 61 is allowed to follow deformation of the elastic layer 63. On the other hand, if the thickness of the surface layer 61 is excessively small, the surface layer 61 can wrinkle due to sliding against the fixing belt 53 or the medium PM. Accordingly, in one example embodiment, the thickness of the surface layer 61 may be within a range from 15 μm to 50 μm both inclusive. Further, it may be desired that the surface layer 61 have heat resistance that allows the surface layer 61 to be resistant to the fixing temperature. It may be also desired that the surface layer 61 have releasability that makes it difficult for the toner remaining on the fixing belt 53 or paper dust derived from the medium PM to be attached to the surface layer 61. Accordingly, in one example embodiment, the surface layer 61 may include a fluorine-substituted material. Note that the material included in the surface layer 61 is not limited to the exemplified material, and the thickness of the surface layer 61 is not limited to the exemplified thickness.

In this example, the adhesive layer 62 may include a silicone adhesive that is sufficiently adhesive, is added with an electrically-conductive material, and is resistant to the fixing temperature. The adhesive layer 62 may adhere the elastic layer 63 and the surface layer 61 to each other in order to suppress peeling off of the surface layer 61 from the elastic layer 63 and to suppress generation of wrinkles of the surface layer 61. Because the adhesive layer 62 is electrically conductive, the adhesive layer 62 may suppress, for example, storing of electric charge on the pressure-applying roller 60 during continuous printing, and may thereby suppress electrostatic attachment of a substance such as paper dust. Note that, although the electrically-conductive material may be added to the adhesive layer 62 in this example, this is non-limiting. In one example embodiment, the electrically-conductive material may not be added. Note that the material included in the adhesive layer 62 is not limited to the exemplified material.

In this example, the elastic layer 63 may include a silicone sponge having a foamed cell to which an electrically-conductive material is added. A thickness of the elastic layer 63 may be, for example, 4 mm. Because the elastic layer 63 is electrically conductive, the elastic layer 63 may suppress, for example, storing of electric charge on the pressure-applying roller 60 during continuous printing, and may thereby suppress electrostatic attachment of a substance such as paper dust. It may be desired that the elastic layer 63 have rubber hardness and a thickness that allow for provision of the nip part N. Further, it may be also desired that the elastic layer 63 have a heat storage characteristic so as to prevent loss in quantity of heat transmitted from the fixing belt 53 to the image and the medium PM. Further, in one example embodiment, a cell diameter of the foamed cell may be small so that no nip mark remains at the nip part N at which pressure is applied. For example, in one example embodiment, an average cell diameter of the foamed cell may be within a range from 20 μm to 250 μm both inclusive. In this example, the average cell diameter of the foamed cell may be 100 μm. The average cell diameter may be measured as follows, for example. That is, a silicone sponge may be cut with use of a tool such as a razor, and the cut silicone sponge may be observed with use of a charged-coupled device (CCD) microscope. Cell diameters of ten cells within an observation viewing angle may be measured, and an average value of the measured cell diameters may be set as a measured value. Note that, although the electrically-conductive material may be added to the elastic layer 63 in this example, this is non-limiting. In one example, the electrically-conductive material may not be added to the elastic layer 63. Further, although the elastic layer 63 may include the silicone sponge in this example, this is non-limiting. In one example, the elastic layer 63 may include any other material. For example, the elastic layer 63 may include solid rubber. Note that the thickness of the elastic layer 63 is not limited to the exemplified thickness.

The shaft 64 may have pressure resistance that prevents deformation due to the fixing pressure. The shaft 64 may include, for example, solid stainless steel (SUS304). Note that, although the shaft 64 may include SUS304 in this example, this is non-limiting. Alternatively, in one example, the shaft 64 may include any other material. Further, although the solid shaft may be used in this example, this is non-limiting. Alternatively, in one example, a hollow shaft may be used.

Here, the fixing belt 53 may correspond to the "belt member" in one specific but non-limiting embodiment of the technology. The base layer 51 may correspond to a "base layer" in one specific but non-limiting embodiment of the technology. The opposed layer 52 may correspond to a "opposed layer" in one specific but non-limiting embodiment of the technology. The fixing device 30 may correspond to a "fixing device" in one specific but non-limiting embodiment of the technology. The heater 44 may correspond to a "heater" in one specific but non-limiting embodiment of the technology. The pressure-applying roller 60 may correspond to a "pressure-applying member" in one specific but non-limiting embodiment of the technology.

Example Workings and Example Effects

A. Basic Operation

The image forming apparatus 1 may transfer an image onto the medium PM as follows.

First, referring to FIG. 1, overall operation of the image forming apparatus 1 is described. When the image forming apparatus 1 receives the print data from the host device, the developing unit 11 may cause the photosensitive drum 12 to rotate, thereby performing an image forming process.

In the image forming apparatus 1, the exposure unit 17 may selectively apply light to the photosensitive drum 12 having the surface electrically charged in the developing unit 11, whereby an electrostatic latent image may be formed on the surface of the photosensitive drum 12. Further, an image may be formed on the photosensitive drum 12 in accordance with the electrostatic latent image.

In a case where the image forming apparatus 1 transfers an image onto the medium PM placed on the medium feeding tray 3, the hopping roller 4 may feed the medium PM toward the paired registration rollers 5 with use of the power transmitted from the unillustrated hopping motor. The paired registration rollers 5 may convey the medium PM toward the image forming section 10. On this occasion, a leading edge of the medium PM may be abutted against the paired registration rollers 5, allowing for correction of a skew of the medium PM.

Thereafter, in the image forming section 10, the transfer belt 19 may rotate circularly, thereby conveying the medium PM toward the fixing device 30. On this occasion, the medium PM may pass between the photosensitive drum 12 and the transfer roller 22.

In the image forming apparatus 1, when an image is formed on the surface of the photosensitive drum 12, the transfer belt section 18 may perform a transfer process. On this occasion, in the transfer belt section 18, the transfer roller 22 may attract the image formed on the surface of the photosensitive drum 12 while the transfer belt 19 conveying the media PM. As a result, the image may be transferred from the photosensitive drum 12 onto the medium PM.

When the image is transferred from the photosensitive drum 12 onto the medium PM, the image forming apparatus 1 may convey the medium PM to the fixing device 30. When the fixing device 30 receives the medium PM, the fixing device 30 may perform a fixing process. On this occasion, the fixing device 30 may apply heat and pressure to the image transferred on the surface of the medium PM, and may thereby melt the image. The fixing device 30 may thus fix the image to the medium PM.

When the image is fixed to the medium PM, the image forming apparatus 1 may convey the medium PM toward the stacker 9, and may discharge the medium PM on the stacker 9.

The overall operation of the image forming apparatus 1 may be as described above.

B. Behavior of Thermal Diffusion Member 50 in Fixing Operation

Next, a description is given of a behavior of the thermal diffusion member 50 in the fixing operation in a case where the medium PM with the transferred image is conveyed from the image forming section 10 toward the fixing device 30.

In a case where the fixing device 30 performs the fixing operation, the drive gear 35 may transmit power from the fixing belt motor to the pressure-applying roller 60. On this occasion, the levers 33L and 33R may be released from the lever fixing member in response to the operation of the drive gear 35. This may cause the levers 33L and 33R to rotate respectively about the rotation fulcrums 34L and 34R as rotational axes in the D1 direction illustrated in FIG. 4. Therefore, the fixing belt section 40 may be pressed against the pressure-applying roller 60, providing the nip part N at the fixing belt section 40 and the pressure-applying roller 60. In this example, a length in the longer-side direction (i.e., the Y-axis direction) of the nip part N may be 227 mm, and a length in the shorter-side direction (substantially, the Z-axis direction) of the nip part N may be within a range from 8 mm to 11 mm both inclusive. The shorter-side direction of the nip part N may be orthogonal to the longer-side direction of the nip part N. A load applied to the fixing belt section 40 may be within a range from 33 kg to 39 kg both inclusive for the entire nip part N. For example, the load applied to the fixing belt section 40 may be 36 kg. Nip pressure for a load of 36 kg may be within a range from 1.32 kg/cm$^2$ to 2.15 kg/cm$^2$ both inclusive. The pressure-applying roller 60 may rotate with use of the power transmitted from the fixing belt motor. The fixing belt 53 may rotate together with the pressure-applying roller 60 in accordance with the rotation of the pressure-applying roller 60. Accordingly, in the fixing belt section 40, the fixing belt 53 and the opposed surface SF of the opposed layer 52 of the thermal diffusion member 50 may slide against each other with the sliding grease therebetween. On this occasion, in the fixing belt section 40, the thermal diffusion member 50 may be pressed against the heater 44. Further, upon the fixing operation, the electric wire 45 may cause a current, supplied from an external power source, to flow through each of the heat generating parts 46*a* to 46*e*, thereby causing the heater 44 to generate heat. The heat generated by the heater 44 may be transmitted to the thermal diffusion member 50 via the heat-conductive grease, and may be further transmitted to the fixing belt 53 via the sliding grease. When the medium PM passes through the nip part N, the image transferred on the medium PM may thereby receive the heat transmitted from the fixing belt 53, and may also receive pressure applied by the nip part N. This may fix the image to the medium PM.

Figure 12:
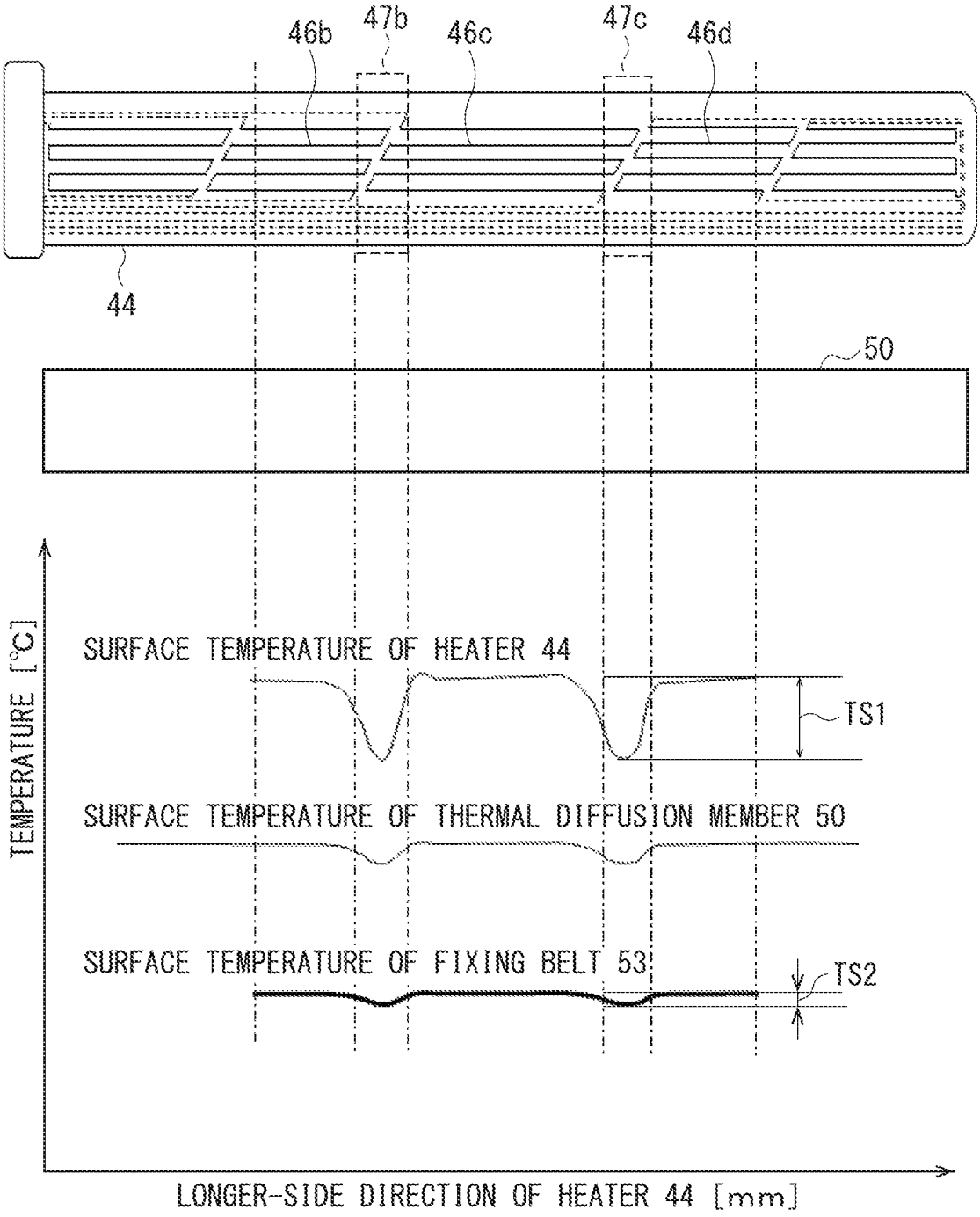
FIG. 12 is a diagram for describing example workings of the thermal diffusion member illustrated in FIG. 5.

FIG. 12 illustrates a relationship between the surface temperature of the heater 44, the surface temperature of the thermal diffusion member 50, and the surface temperature of the fixing belt 53 in the fixing operation. A horizontal axis in FIG. 12 represents a length in the longer-side direction (i.e., the Y-axis direction) of the heater 44, and a vertical axis represents a temperature. FIG. 12 illustrates: an example of a positional relationship between the heater 44 and the thermal diffusion member 50; and a result of measurement of the surface temperatures of the heater 44, the thermal diffusion member 50, and the fixing belt 53 within a range from the heat generating part 46*b* to the heat generating part 46*d* of the heater 44. In the heat generating parts 46*b*, 46*c*, and 46*d*, the surface temperature of the heater 44 may be high. In contrast, in the joining parts 47*b* and 47*c*, the surface temperature of the heater 44 may be low. Therefore, a part having the high surface temperature of the heater 44 and a part having the low surface temperature of the heater 44 may have a temperature difference TS1. Because heat is transmitted to the thermal diffusion member 50 in accordance with the distribution of the surface temperature of the heater 44, the thermal diffusion member 50 may also involve a temperature difference between a part having a high surface temperature and a part having a low surface temperature; however, this temperature difference may be smaller than the temperature difference TS1. That is, the thermal diffusion member 50 may attempt to uniformize the temperature distribution in the longer-side direction (i.e., the Y-axis direction) of the heater 44. Because heat is transmitted to the fixing belt 53 in accordance with the distribution of the surface temperature of the thermal diffusion member 50, the fixing belt 53 may also involve a temperature difference TS2 between a part having a high surface temperature and a part having a low surface temperature; however, the temperature difference TS2 may be smaller than the temperature difference in the thermal diffusion member 50. In one example embodiment, the temperature difference TS2 may be equal to or less than 2° C. In this case, in the fixing belt 53, a difference between a reflectivity of the part having the high surface temperature and a reflectivity of the part having the low surface temperature may be, for example, equal to or less than 2.8, making it difficult to visually recognize a difference in glossiness. That is, in a case where the temperature difference TS2 is equal to or less than 2° C., even the part having the low surface temperature in the fixing belt 53 may have a temperature that allows for melting of the toner, making it difficult for uneven glossiness in the image to occur. Further, in the thermal diffusion member 50, because the base layer 51 and the opposed layer 52 are configured to cause the heat transmission contribution rate to be equal to or less than 1.17 as described in the conditional expression (1), the base layer 51 and the opposed layer 52 efficiently transmit heat to the fixing belt 53. This helps to suppress an increase in the fixing limit temperature.

C. Example Effects

As described above, according to the example embodiment, the base layer 51 and the opposed layer 52 in the thermal diffusion member 50 allow the heat transmission contribution rate to satisfy the conditional expression (1). Therefore, it is possible to obtain a more favorable fixing performance according to the example embodiment. That is, generally, the fixing device 30 is sometimes provided with, for example, the opposed layer on the base layer of the thermal diffusion member transmitting heat generated by the heater, in order to improve slidability. For example, glass can be used for the opposed layer. However, a thermal diffusivity of the opposed layer including glass is smaller than that of the base layer including metal. In this case, there is a possibility that the small thermal diffusivity of the opposed layer prevents efficient transmission of the heat generated by the heater to the fixing belt in the fixing device 30. In contrast, in the fixing device 30 according to the example embodiment, the base layer 51 and the opposed layer 52 allow the heat transmission contribution rate to satisfy the conditional expression (1). This makes it possible for the base layer 51 and the opposed layer 52, for example, to efficiently transmit the heat generated by the heater 44 to the fixing belt 53. Accordingly, it is possible to obtain a more favorable fixing performance.

Moreover, according to the example embodiment, the base layer 51 and the opposed layer 52 may transmit the heat generated by the heater 44 to the fixing belt 53 substantially uniformly. As a result, it is possible to suppress occurrence of uneven glossiness of an image, according to the example embodiment. That is, for example, in a fixing device having a heat transmission member having a small thermal diffusivity, the heater 44 has a low temperature in the joining parts 47*a* to 47*d*, therefore involving a temperature difference between the joining parts 47*a* to 47*d* and the heat generating parts 46*a* to 46*e*. This can result in insufficient uniformization of the heat generated by the heater 44. As a result, the heat is not uniformly transmitted to the image on the medium PM, preventing the toner from melting completely and therefore preventing the toner from being fixed to a part of the image. Such a part of the image can have low glossiness, appearing as a vertical streak on the medium PM which results in uneven glossiness, for example. In contrast, according to the example embodiment, the base layer 51 and the opposed layer 52 in the thermal diffusion member 50 may transmit the heat generated by the heater 44 to the fixing belt 53 substantially uniformly. Accordingly, it is possible to suppress occurrence of uneven glossiness in the image.

Moreover, according to the example embodiment, the opposed layer 52 of the fixing belt 53 may include PAI. This makes it possible to reduce a material cost and a manufacturing cost for the opposed layer 52, for example, compared with an opposed layer including glass which is adapted for screen printing. Further, for example, as compared with a case of adopting glass, the opposed layer 52 including PAI may have a lower thermal diffusivity Db and may have a thinner layer, allowing for an increase in the thermal diffusivity of the thermal diffusion member as a whole. Further, for example, as compared with the case of adopting glass, the opposed layer 52 including PAI allows for improvement of slidability. Accordingly, it is possible to suppress generation of a scratch on the inner circumferential surface of the fixing belt 53.

Moreover, according to the present embodiment, the base layer 56 of the fixing belt 53 may include PI. This allows for lower strength of the opposed layer 52 that slides against the fixing belt 53, for example, as compared with a case where the base layer of the fixing belt includes metal. For this reason, for example, resin having strength lower than that of glass may be adopted for the opposed layer 52. As a result, it is possible to reduce a material cost and a manufacturing cost for the opposed layer 52. Further, for example, it is possible to increase the thermal diffusivity of the thermal diffusion member as a whole, as compared with a case of adopting glass. Further, for example, as compared with the case of adopting glass, it is possible to improve slidability, therefore suppressing generation of a scratch on the inner circumferential surface of the fixing belt 53.

The base layer 51 may include Al, and the thickness Tb of the opposed layer 52 may be equal to or less than 0.015 mm. As a result, the thermal diffusivity Da of the base layer 51 may be greater, for example, than a thermal diffusivity of the base layer including SUS. Further, because the thickness Tb of the opposed layer 52 may be smaller with respect to the thickness Ta of the base layer 51, it is possible to increase the thermal diffusivity of the thermal diffusion member as a whole. As a result, it is possible to obtain a more favorable fixing performance.

2. Experiment Examples

Experiment Example 1-1

A thermal diffusion member without the opposed layer being formed on the base layer 51 including Al was fabricated. In an image forming apparatus (a color printer C833 available from Oki Data Corporation, Tokyo, Japan) including a fixing device to which the fabricated thermal diffusion member was applied, a fixing limit temperature was measured. In this example, it was confirmed whether a scratch was made on the fixing belt 53 in a state where printing had been performed on fifty-thousand sheets of media PM (hereinafter, referred to as a "post-printing state").

The thickness Ta of the base layer 51 was 0.485 mm, which was measured with use of a micrometer MDC-25MJ (available from Mitutoyo Corporation, Kanagawa, Japan). The thickness of the base layer 51 was measured at three points in the longer-side direction (i.e., the Y-axis direction) and an average value of the thicknesses of the three points was set as a measured value. The thermal diffusivity Da of the base layer 51 was measured by a periodic heating radiation temperature measurement with use of a thermowave analyzer TA35 (available from Bethel Co., Ltd., Ibaraki, Japan). A sample whose thermal diffusivity Da was measured had a size of 15 mm×40 mm. A graphite spray was applied on both sides of the sample, thereby performing a blackening process. Laser was caused to enter the base layer 51 from the surface opposed to the heater 44, whereby a temperature of the surface, of the base layer 51, opposed to the fixing belt 53 was measured. As a heating light, a semiconductor laser having a measurement spot diameter of 500 μm and a wavelength of 808 nm was used. As a temperature detector, InSb which was a semiconductor device was used. The temperature detector detected infrared rays and thereby measured the temperature. An environment temperature at the time of the measurement was 25° C. That is, because the thermal diffusivity Da was not so variable with respect to the environment temperature, the thermal diffusivity Da at 25° C. was measured. The measured thermal diffusivity Da was 57.7 $mm^2/s$.

Further, the fixing limit temperature was measured. In this example, the fixing limit temperature was a lower limit of the surface temperature of the fixing belt 53 which allows for satisfying a fixing rate of 80% or greater. The fixing rate was as described below. First, the image forming apparatus 1 formed a pattern on the medium PM at Duty 100%. Here, the term "Duty 100%" refers to that a printed region occupied 100% of an area of a predetermined printable region. The predetermined printable region corresponded to, for example, one round of the photosensitive drum or one page of a medium. The term "Duty 1%" refers to, for example, that the printed region occupied 1% of the area of the printable region. That is, an area occupied by the image formed at Duty 1% corresponded to 1% of an area occupied by the image formed at Duty 100%. Duty was represented by the following expression (2).

$$\text{Duty}=[Cm(i)/(Cd\times C0)]\times 100 \quad (2)$$

In the expression (2), Cm(i) is the number of dots used in printing for Cd-round rotation of the photosensitive drum 12. That is, Cm(i) is the number of dots subjected to exposure. C0 is the maximum number of dots that were usable for printing in single-round rotation of the photosensitive drum 12. That is, C0 is the number of dots that were potentially usable for single-round rotation of the photosensitive drum 12, regardless of whether exposure was performed or not. Cd×C0 is the maximum number of dots that were usable in printing for Cd-round rotation of the photosensitive drum 12. A mending tape (available from 3M, Minnesota, US) was attached to an image fixed to the medium PM, and a cylindrical weight including brass was applied thereon in a direction from one side to the other and was applied again in a reverse direction at a speed of 1 cm/sec. Thereafter, the mending tape was peeled off slowly. The cylindrical weight had a diameter of about 5 cm, a thickness of about 3 cm, and a weight of 500 g. Thereafter, an image density was measured with use of a spectrodensitometer X-Rite 528 (available from X-Rite Inc., Michigan, US), and the fixing rate was calculated by the following expression (3).

$$\text{Fixing rate}=(\text{image density after peeling off the mending tape/image density before peeling off the tape})\times 100 \quad (3)$$

As described above, the fixing rate was calculated for various fixing temperatures, and the fixing temperature at which the fixing rate was 80% was set as the fixing limit temperature for the measurement.

In this Experiment example 1-1, no opposed layer was formed on the base layer 51. Therefore, the thickness Tb of the opposed layer was 0 mm, and the heat transmission contribution rate of the thermal diffusion member in Experiment example 1-1 was 0.00. Further, the fixing limit temperature in Experiment example 1-1 was set as a reference value of the fixing limit temperature for measurement in Experiment examples 1-2 to 1-6. It was confirmed that a scratch was made on the fixing belt 53. Specifically, the inner circumferential surface of the fixing belt 53 was visually observed, thereby confirming that the scratch was made on the fixing belt 53. Test conditions and measurement results are summarized in Table 1 together with test conditions and measurement results in the other experiment examples described later.

TABLE 1

| | | Experiment example 1-1 | Experiment example 1-2 | Experiment example 1-3 | Experiment example 1-4 | Experiment example 1-5 |
|---|---|---|---|---|---|---|
| Base | | Al | Al | Al | Al | Al |
| Base layer | Thickness Ta [mm] | 0.485 | 0.485 | 0.485 | 0.485 | 0.485 |
| | Thermal diffusivity Da [$mm^2/s$] | 57.7 | 57.7 | 57.7 | 57.7 | 57.7 |
| Opposed layer | Thickness Tb [mm] | 0 | 0.005 | 0.01 | 0.015 | 0.02 |
| | Thermal diffusivity Db [$mm^2/s$] | 1.53 | 1.53 | 1.53 | 1.53 | 1.53 |
| Thickness contribution | Tb/Ta | 0.000 | 0.010 | 0.021 | 0.031 | 0.041 |
| Thermal diffusivity contribution | Db/Da | 0.027 | 0.027 | 0.027 | 0.027 | 0.027 |
| Heat transmission contribution rate | (Tb · Da)/(Ta · Db) | 0.00 | 0.39 | 0.78 | 1.17 | 1.56 |
| Increase in fixing limit temperature [° C.] | | 0.0 | 0.1 | 0.5 | 0.9 | 2.0 |
| Scratch on fixing belt 53 | | Yes | No | No | No | No |

| | | | Experiment example 1-6 | Experiment example 2-1 | Experiment example 2-2 | Experiment example 3-1 |
|---|---|---|---|---|---|---|
| | Base | | Al | SUS | SUS | SUS |
| | Base layer | Thickness Ta [mm] | 0.485 | 0.550 | 0.550 | 0.550 |
| | | Thermal diffusivity Da [$mm^2/s$] | 57.7 | 7.45 | 7.45 | 7.45 |
| | Opposed layer | Thickness Tb [mm] | 0.03 | 0 | 0.03 | 0.06 |
| | | Thermal diffusivity Db [$mm^2/s$] | 1.53 | 1.53 | 1.53 | 0.50 |
| | Thickness contribution | Tb/Ta | 0.062 | 0.000 | 0.055 | 0.109 |
| | Thermal diffusivity contribution | Db/Da | 0.027 | 0.205 | 0.205 | 0.067 |
| | Heat transmission contribution rate | (Tb · Da)/(Ta · Db) | 2.33 | 0.00 | 0.27 | 1.63 |
| | Increase in fixing limit temperature [° C.] | | 3.0 | 0.0 | 0.1 | 2.0 |
| | Scratch on fixing belt 53 | | No | Yes | No | No |

Experiment Example 1-2

The thermal diffusion member 50 with the opposed layer 52 being formed on the base layer 51 including Al was fabricated. In the image forming apparatus 1 including the fixing device 30 to which the fabricated thermal diffusion member 50 was applied, a fixing limit temperature was measured, and it was confirmed whether a scratch was made on the fixing belt 53, as with Experiment example 1-1. In Experiment example 1-2, the opposed layer 52 was so formed on the base layer 51 that the thickness Tb of the opposed layer 52 was 0.005 mm. Note that, one reason for this was that, in a case where the thickness Tb was less than 0.005 mm, there was a possibility that, for example, the base layer 51 might be partially uncovered. The thickness Tb of the opposed layer 52 was 0.005 mm, which was measured with use of an eddy-current coating thickness tester LH-373 (available from Kett Electric Laboratory, Tokyo, Japan). The thickness of the opposed layer 52 was measured at three points in the longer-side direction (i.e., the Y-axis direction) of the opposed layer 52 and an average value of the thicknesses of the three points was set as a measured value. Further, the thermal diffusivity Db was measured as with the thermal diffusivity Da. Upon the measurement, because the opposed layer 52 including resin had no anisotropy, the opposed layer 52 having the thickness of 30 μm and formed on the base layer 51 was peeled off from the base layer 51 with use of a solvent such as ethanol that weakened adhesivity of the interface, whereby a sample was prepared. The thermal diffusivity Db was 1.53 $mm^2/s$. The heat transmission contribution rate in Experiment example 1-2 was 0.39. Regarding the fixing belt 53, an increase in fixing limit temperature in Experiment example 1-2 from that in Experiment example 1-1 was 0.1° C. Any scratch was not confirmed on the fixing belt 53.

Experiment Example 1-3

The opposed layer 52 was so formed on the base layer 51 that the thickness Tb of the opposed layer 52 was 0.01 mm. The thermal diffusion member 50 was fabricated in a manner similar to that in Experiment example 1-2 except for this point. Evaluation was made for the image forming apparatus 1 including the fixing device 30 to which the fabricated thermal diffusion member 50 was applied. The heat transmission contribution rate in Experiment example 1-3 was 0.78. Regarding the fixing belt 53, an increase in fixing limit temperature in Experiment example 1-3 from that in Experiment example 1-1 was 0.5° C. Any scratch was not confirmed on the fixing belt 53.

Experiment Example 1-4

The opposed layer 52 was so formed on the base layer 51 that the thickness Tb of the opposed layer 52 was 0.015 mm. The thermal diffusion member 50 was fabricated in a manner similar to that in Experiment example 1-2 except for this point. Evaluation was made for the image forming apparatus 1 including the fixing device 30 to which the fabricated thermal diffusion member 50 was applied. The heat transmission contribution rate of the thermal diffusion member 50 in Experiment example 1-4 was 1.17. Regarding the fixing belt 53, an increase in fixing limit temperature in Experiment example 1-4 from that in Experiment example 1-1 was 0.9° C. Any scratch was not confirmed on the fixing belt 53.

Experiment Example 1-5

The opposed layer 52 was so formed on the base layer 51 that the thickness Tb of the opposed layer 52 was 0.02 mm. The thermal diffusion member 50 was fabricated in a manner similar to that in Experiment example 1-2 except for this point. Evaluation was made for the image forming apparatus 1 including the fixing device 30 to which the fabricated thermal diffusion member 50 was applied. The heat transmission contribution rate of the thermal diffusion member 50 in Experiment example 1-5 was 1.56. Regarding the fixing belt 53, an increase in fixing limit temperature in Experiment example 1-5 from that in Experiment example 1-1 was 2.0° C. Any scratch was not confirmed on the fixing belt 53.

Experiment Example 1-6

The opposed layer 52 was so formed on the base layer 51 that the thickness Tb of the opposed layer 52 was 0.03 mm. The thermal diffusion member 50 was fabricated in a manner similar to that in Experiment example 1-2 except for this point. Evaluation was made for the image forming apparatus 1 including the fixing device 30 to which the fabricated thermal diffusion member 50 was applied. The heat transmission contribution rate of the thermal diffusion member 50 in Experiment example 1-6 was 2.33. Regarding the fixing belt 53, an increase in fixing limit temperature in Experiment example 1-6 from that in Experiment example 1-1 was 3.0° C. Any scratch was not confirmed on the fixing belt 53.

Experiment Example 2-1

The base layer 51 included SUS and was so formed as to have a thickness of 0.550 mm. The thermal diffusion member was fabricated in a manner similar to that in Experiment example 1-1 except for this point. Evaluation was made for an image forming apparatus including a fixing device to which the fabricated thermal diffusion member was applied. The thermal diffusivity Da was 7.45 $mm^2/s$. In Experiment example 2-1, no opposed layer was formed on the base layer 51. Therefore, the thickness Tb of the opposed layer was 0 mm, and the heat transmission contribution rate of the thermal diffusion member in Experiment example 2-1 was 0.00. Further, the fixing limit temperature in Experiment example 2-1 was set as a reference value of the fixing limit temperature for measurement in Experiment examples 2-2 and 3-1. It was confirmed that a scratch was made on the fixing belt 53.

Experiment Example 2-2

The opposed layer 52 was so formed on the base layer 51 including SUS that the thickness Tb of the opposed layer 52 was 0.03 mm. The thermal diffusion member 50 was fabricated in a manner similar to that in Experiment example 2-1 except for this point. Evaluation was made for the image forming apparatus 1 including the fixing device 30 to which the fabricated thermal diffusion member 50 was applied. The heat transmission contribution rate of the thermal diffusion member 50 in Experiment example 2-2 was 0.27. Regarding the fixing belt 53, an increase in fixing limit temperature in Experiment example 2-2 from that in Experiment example 2-1 was 0.1° C. Any scratch was not confirmed on the fixing belt 53.

Experiment Example 3-1

An opposed layer including glass was so formed on the base layer 51 including SUS that the thickness Tb of the opposed layer was 0.06 mm. This opposed layer may be formed, for example, by screen printing. Note that the thickness Tb of the glass formable by the screen printing may be, for example, within a range from 0.04 mm to 0.06 mm, both inclusive. The thermal diffusion member was fabricated in a manner similar to that in Experiment example 2-2 except for this point. Evaluation was made for an image forming apparatus including a fixing device to which the fabricated thermal diffusion member was applied and that included a base layer including metal. The heat transmission contribution rate of the thermal diffusion member in Experiment example 3-1 was 1.63. Regarding the fixing belt according to Experiment example 3-1, an increase in fixing limit temperature in Experiment example 3-1 from that in Experiment example 2-1 was 2.0° C. Any scratch was not confirmed on the fixing belt of Experiment example 3-1.

As a result, it was confirmed that the scratch was made on the fixing belt 53 in the post-printing state in Experiment examples 1-1 and 2-1. One reason for this is poor slidability between the base layer including metal and the inner circumferential surface of the fixing belt 53. In contrast, it was confirmed that no scratch was made on the fixing belt 53 in the post-printing state in Experiment examples 1-2 to 1-6, 2-2, and 3-1. It was confirmed that provision of the opposed layer makes it possible to suppress generation of a scratch on the fixing belt 53. Further, in Experiment examples 1-2 to 1-6, it was confirmed that an increase in the thickness Tb of the opposed layer 52 results in an increase in the heat transmission contribution rate, and the fixing limit temperature is equal to or less than 0.9 in a case where the heat transmission contribution rate is equal to or less than 1.17.

In Experiment example 2-2, a ratio (i.e., thickness contribution) of the thickness Tb of the opposed layer 52 to the thickness Ta of the base layer 51 is 0.055, which is greater than the thickness contribution of 0.041 in Experiment example 1-5, but an increase in temperature of the fixing limit temperature is 0.1° C. One reason for this is that, in Experiment example 2-2, the ratio (i.e., thermal diffusivity contribution) of the thermal diffusivity Db of the opposed layer 52 to the thermal diffusivity Da of the base layer 51 is 0.205, which is greater than 0.027 that is the thermal diffusivity contribution in Experimental Example 1-5.

Figure 13:
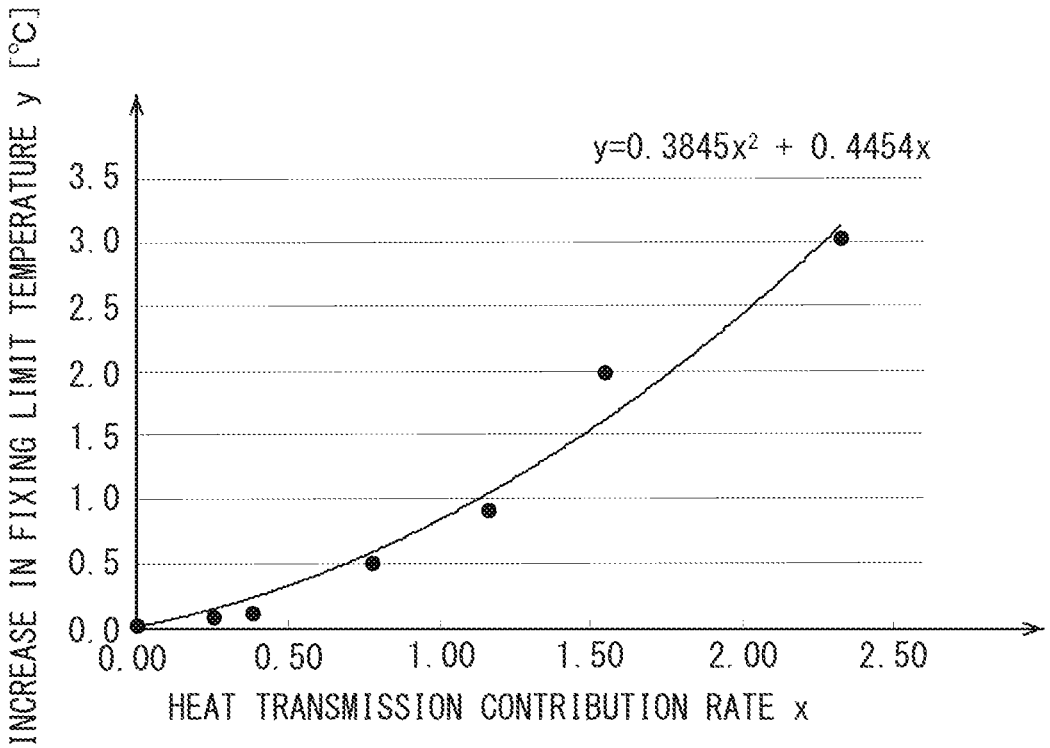
FIG. 13 is a characteristic diagram illustrating a characteristic of a fixing device in an experiment example.

FIG. 13 illustrates a relationship between the heat transmission contribution rate and the increase in the fixing limit temperature. In FIG. 13, a horizontal axis represents the heat transmission contribution rate, and a vertical axis represents the increase in the fixing limit temperature. The heat transmission contribution rate and the increase in the fixing limit temperature are correlated to each other. The relationship between the heat transmission contribution rate and the increase in the fixing limit temperature can be expressed by the following expression (4), where x is the heat transmission contribution rate and y is the increase in the fixing limit temperature. A coefficient of determination is 0.9786.

$$y=0.3845x^2+0.4454x \quad (4)$$

Thus, the higher the heat transmission contribution rate is, the greater the increase in the fixing limit temperature becomes. The fixing temperature of the fixing operation may be set with a margin being secured with respect to the fixing limit temperature. For example, the fixing temperature may be set to, a temperature higher than the fixing limit temperature by about 15° C. For this reason, as described in in Experiment example 1-4, if the increase in the fixing limit temperature is equal to or less than 0.9° C., it can be considered that the possibility of deterioration of the fixing rate is low.

3 Modification Examples

Although the technology has been described with reference to some example embodiments and experiment examples, the technology is not limited thereto, and may be modified in a variety of ways. For example, in the example embodiments and the experiment examples described above, an embodiment of the technology may be applied to a single-function printer; however, this is non-limiting. Alternatively, an embodiment of the technology may be applied to a so-called multifunctional peripheral device (MFP) having multiple functions including, without limitation, a copy function, a fax function, a scan function, and a print function.

Moreover, in the example embodiments and the experiment examples described above, the image may be formed on the medium PM by the electrophotographic method; however, this is non-limiting, and the image may be formed by any method. Moreover, in the example embodiments and the experiment examples described above, images of four colors including black, yellow, magenta, and cyan may be formed by the four developing units 11; however, this is non-limiting. Alternatively, images may be formed by one or more developing units, for example.

Moreover, in the example embodiments and the experiment examples described above, the image formed by the image forming section 10 may be transferred directly onto the medium PM; however, this is non-limiting. Alternatively, for example, the image formed by the image forming section 10 may be temporarily transferred onto an intermediate transfer belt, and the image transferred on the intermediate transfer belt may be transferred, in turn, onto the medium PM.

Furthermore, the technology encompasses any possible combination of some or all of the various embodiments and the modifications described herein and incorporated herein. It is possible to achieve at least the following configurations from the above-described example embodiments of the technology.

[1]

A fixing device including:

a belt member;

a heater provided on an inner circumferential surface of the belt member;

a base layer that includes a first surface on a heater side and a second surface on an opposite side to the first surface; and an opposed layer that covers the second surface and is opposed to the inner circumferential surface of the belt member;

the base layer and the opposed layer satisfying the following conditional expression (1), $$0<(Tb\times Da)/(Ta\times Db)\leq 1.17 \quad (1)$$

where Ta is a thickness of the base layer in millimeters,

Tb is a thickness of the opposed layer in millimeters,

Da is a thermal diffusivity of the base layer in square millimeters per second, and Db is a thermal diffusivity of the opposed layer in square millimeters per second.

[2]

The fixing device according to [1], in which the thickness of the opposed layer is equal to or greater than 0.005 millimeters and equal to or less than 0.03 millimeters, and the base layer and the opposed layer further satisfy the following conditional expression (2), $$0.2\gamma \leq (Tb \times Da)/(Ta \times Db) \quad (2)$$

[3]

The fixing device according to [1] or [2], further including a lubricant that is provided between the opposed layer and the belt member.

[4]

The fixing device according to any one of [1] to [3], in which the base layer includes aluminum as a major component, and the thickness of the opposed layer is equal to or less than 0.015 millimeters.

[5]

The fixing device according to any one of [1] to [4], in which the opposed layer includes resin as a major component.

[6]

The fixing device according to any one of [1] to [5], in which the thermal diffusivity of the base layer is greater than the thermal diffusivity of the opposed layer.

[7]

The fixing device according to any one of [1] to [6], in which the thickness of the base layer is greater than the thickness of the opposed layer.

[8]

The fixing device according to any one of [1] to [7], in which the belt member includes resin as a major component.

[9]

The fixing device according to any one of [1] to [8], in which the base layer and the opposed layer transmit heat generated by the heater to the belt member.

[10]

The fixing device according to any one of [1] to [9], further including a pressure-applying member that is provided in a state of being able to come into contact with a surface of the belt member.

[11]

An image forming apparatus including the fixing device according to any one of [1] to [10].

According to any of the fixing device and the image forming apparatus of one embodiment of the technology, the base layer and the opposed layer satisfy the conditional expression (1) described above. This allows the base layer and the opposed layer to efficiently transmit heat to the belt member. Accordingly, it is possible to obtain a more favorable fixing performance.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A fixing device comprising:

a belt member;

a heater provided on an inner circumferential surface of the belt member;

a base layer that includes a first surface on a heater side and a second surface on an opposite side to the first surface; and an opposed layer that covers the second surface and is opposed to the inner circumferential surface of the belt member;

the base layer and the opposed layer satisfying the following conditional expression (1), $$0 < (Tb \times Da)/(Ta \times Db) \leq 1.17 \quad (1)$$

where Ta is a thickness of the base layer in millimeters,

Tb is a thickness of the opposed layer in millimeters,

Da is a thermal diffusivity of the base layer in square millimeters per second, and Db is a thermal diffusivity of the opposed layer in square millimeters per second.

2. The fixing device according to claim 1, wherein the thickness of the opposed layer is equal to or greater than 0.005 millimeters and equal to or less than 0.03 millimeters, and the base layer and the opposed layer further satisfy the following conditional expression (2), $$0.27 \leq (Tb \times Da)/(Ta \times Db) \quad (2).$$

3. The fixing device according to claim 1, further comprising a lubricant that is provided between the opposed layer and the belt member.

4. The fixing device according to claim 1, wherein the base layer includes aluminum as a major component, and the thickness of the opposed layer is equal to or less than 0.015 millimeters.

5. The fixing device according to claim 1, wherein the opposed layer includes resin as a major component.

6. The fixing device according to claim 1, wherein the thermal diffusivity of the base layer is greater than the thermal diffusivity of the opposed layer.

7. The fixing device according to claim 1, wherein the thickness of the base layer is greater than the thickness of the opposed layer.

8. The fixing device according to claim 1, wherein the belt member includes resin as a major component.

9. The fixing device according to claim 1, wherein the base layer and the opposed layer transmit heat generated by the heater to the belt member.

10. The fixing device according to claim 1, further comprising a pressure-applying member that is provided in a state of being able to come into contact with a surface of the belt member.

11. An image forming apparatus comprising a fixing device including:

a belt member;

a heater provided on an inner circumferential surface of the belt member;

a base layer that includes a first surface on a heater side and a second surface on an opposite side to the first surface; and an opposed layer that covers the second surface and is opposed to the inner circumferential surface of the belt member;

the base layer and the opposed layer satisfying the following conditional expression (1), $$0<(Tb\times Da)/(Ta\times Db)\leq 1.17 \quad (1)$$

where Ta is a thickness of the base layer in millimeters,

Tb is a thickness of the opposed layer in millimeters,

Da is a thermal diffusivity of the base layer in square millimeters per second, and Db is a thermal diffusivity of the opposed layer in square millimeters per second.

* * * * *